US005738505A

United States Patent [19]

Mezzedimi et al.

[11] Patent Number: 5,738,505

[45] Date of Patent: Apr. 14, 1998

[54] PERFECTED TWIN-SCREW PUMP, PARTICULARLY SUITABLE FOR THE PUMPING OF BIPHASE FLUIDS IN A SUBMERGED ENVIRONMENT

[75] Inventors: Vasco Mezzedimi, Poggibonsi; Giampietro Ferrari Aggradi, Florence, both of Italy

[73] Assignee: Nuovo Pignone S.p.A., Florence, Italy

[21] Appl. No.: 700,859

[22] Filed: Aug. 21, 1996

[30] Foreign Application Priority Data

Sep. 5, 1995 [IT] Italy ..... MI95A1864

[51] Int. Cl.[6] ..... F04C 2/16; F04C 13/00

[52] U.S. Cl. ..... 418/102; 418/202

[58] Field of Search ..... 418/94, 99, 202, 418/102

[56] References Cited

U.S. PATENT DOCUMENTS

| | | | |
|---|---|---|---|
| Re. 18,527 | 7/1932 | Simmons | 418/202 |
| 1,475,683 | 11/1923 | Carrey | 418/202 |
| 2,463,080 | 3/1949 | Beler | 418/206.6 |
| 3,391,643 | 7/1968 | Zalis | 418/202 |
| 3,667,879 | 6/1972 | Cerpelli | 418/202 |
| 4,828,036 | 5/1989 | Simmons | 166/369 |
| 5,396,784 | 3/1995 | Huenniger | 62/471 |

FOREIGN PATENT DOCUMENTS

| | | | |
|---|---|---|---|
| 2305305 | 8/1974 | Germany . | |
| 46-20418 | 6/1971 | Japan | 418/202 |
| 1196846 | 7/1970 | United Kingdom . | |
| 2165890 | 4/1986 | United Kingdom . | |
| 90/08901 | 8/1990 | WIPO . | |

*Primary Examiner*—John J. Vrablik

*Attorney, Agent, or Firm*—Rogers & Wells; George P. Hoare

[57] ABSTRACT

Twin-screw pump, wherein the four conical screws are vertically arranged and are fed with biphase fluid at the two ends, independently of each other, by means of a stream divider and wherein the two screw shafts each have a central axial drilling which connects the delivery chamber to a series of radial channels which end up on the tip of the single teeth of the screws. A preferen-tial stream divider is described.

2 Claims, 1 Drawing Sheet

PERFECTED TWIN-SCREW PUMP, PARTICULARLY SUITABLE FOR THE PUMPING OF BIPHASE FLUIDS IN A SUBMERGED ENVIRONMENT

The present invention relates to a twin-screw pump which, by guaranteeing feedings by suction at the two ends of the pump which are always perfectly the same in gas content, as well as sealing between the screws and wall of the pumping chamber of the pump body, also in the transient pumping phase of gas alone, ensures the efficient and safe pumping of a biphase fluid even when the pump is in a vertical position, making it particularly suitable for submerged applications.

As is known, a screw pump is basically a rotating pump in which the positive mechanical movement of the fluid, generally a liquid, from the suction to the delivery, is obtained along a conical cavity created by the in gear of a pair of conical screws firmly geared to each other and with a synchronized movement, the seal between the teeth of the two screws and the wall of the pumping chamber of the pump body being ensured by a film of the centrifuged liquid itself. In order to balance the axial thrusts created by the movement of the fluid, according to a preferential embodiment of the art, the so-called "twin-screw pump" is used, i.e. a pump with a double pair of synchronized conical screws, co-axially connected in series to each other and equipped with opposite propellers. In this pump, in fact, the single suction is subdivided, inside the pump body, into two feedings of the two opposite ends of the pump and consequently, owing to the opposite threads of the two pairs of screws, there are two fluid streams, in opposite directions, towards the central zone or the delivery zone of the pump, which create an equilibrium in the force of the axial thrust.

This type of pump is generally used horizontally, i.e. with the axis of symmetry of the pump horizontally arranged, and has a high efficiency, which increases with the constructive and assembly precision of the pump.

On the other hand, this known pump, in the pumping of liquids, can also be used vertically, which, as is known, is the best and most congenial position for a submerged installation of a pump.

At present, however, there is a great request for a pump which is capable of functioning efficiently with biphase mixtures of liquid and gas, for use on the sea floor for the direct pumping of offshore oil wells, without the help of costly platforms.

This twin-screw pump is already intrinsically capable of pumping not only liquids but also biphase mixtures of liquid and gas.

In this particular application however, it can inevitably only be positioned horizontally as a vertical position would create a distinct division of the mixture and the liquid, because of gravity, would settle at the lower feeding end of the pump and the gas on the other hand would settle at the upper feeding end of the pump, with the result that the upper pair of screws, in contact only with the gas and therefore not cooled by the liquid, would become overheated and would grip.

In addition, the above known pump, also in a horizontal position, can in no way function in the presence of gas alone, as often happens in oil wells, as the absence of a liquid phase which, as already mentioned, determines the centrifuged liquid film seal, prejudices the seal itself in correspondence with the screws and the pump is deactivated and stops functioning.

Attempts have been made to overcome this latter drawback using tricks such as providing the delivery of the pump with a liquid seal generator of the liquid phase which accumulates the liquid to be used for maintaining or creating a liquid seal, but not even this solution has completely solved the problem in the presence of very high vacuum fractions, vacuum fraction meaning the ratio between the quantity of gas present in the mixture and the quantity of mixture aspirated.

The object of the present invention is to overcome the above drawbacks and consequently to provide a screw pump, of the twin-screw type, which functions perfectly in a vertical position, in the biphase field of liquid-gas mixtures, even in the absence of a liquid phase.

This is basically achieved by the fact that the feeding of the two opposite ends, upper and lower, of the pump or feeding mouths is carried out separately by means of a stream divider placed between the single suction pipe and said feeding mouths and by the fact that the screw shafts are equipped with a central axial drilling which connects between them and the delivery mouth of the pump a series of radial channels which end up on the tips of the single teeth.

This in fact guarantees that the two feeding mouths of the pump are always supplied with quantities of fluid which are perfectly equal in gas content, even when the pump is in a vertical position, and that a minimum quantity of liquid stored in the liquid seal generator of the liquid phase, situated on the delivery mouth, pushed by the delivery pressure inside the central drilling and channels, creates an effective liquid seal which also allows the pumping of the gaseous phase alone.

In short, the twin-screw pump, comprising a suction pipe of the fluid which is connected to two feeding mouths of the fluid placed respectively at the two ends of a twin pair of conical screws, the screws of each pair being interlocked and their shafts co-axially connected in series with those of the other pair, wherein the screws rotate in synchronism, by means of a motor, inside a pumping chamber and the propeller of one pair is opposite to that of the other pair so as to convey the streams from the feeding mouths into the centre of the pumping chamber where there is a delivery chamber whose mouth is connected to a liquid seal generator of the liquid phase, is characterized, according to the present invention, by the fact that the twin pair of conical screws is in a vertical position, the suction pipe of the fluid is connected to the two feeding mouths of the fluid, with separate pipes, by means of a stream divider and each of the two shafts of the twin pair of conical screws is equipped with a central axial drilling connecting between them and the delivery chamber a series of radial channels which end up on the tips of the single teeth of the conical screws.

According to a preferred embodiment of the present invention, the stream divider consists of a horizontal expansion/separation barrel, connected on one side to the suction pipe and equipped longitudinally, half way down, with a vertical internal dividing wall creating two equal chambers which are connected respectively, on the other side of the barrel, to the two feeding mouths of the fluid in the pump.

In this way, in fact, the separation takes place in the barrel of the phases of the biphase mixture supplied by the suction pipe, with the gas settling in the upper part of the barrel and the liquid settling in the lower part; on the other side the dividing wall perfectly subdivides the mixture into two equal parts, thus guaranteeing that the feeding mouths of the pump are supplied with an equal composition of fluid, even if arranged at different heights.

The invention can be better explained with reference to the enclosed drawings which describe a preferred practical embodiment which is purely illustrative and not limiting as technical or constructive variations can be applied which still remain within the scope of the present invention.

Figure 1:
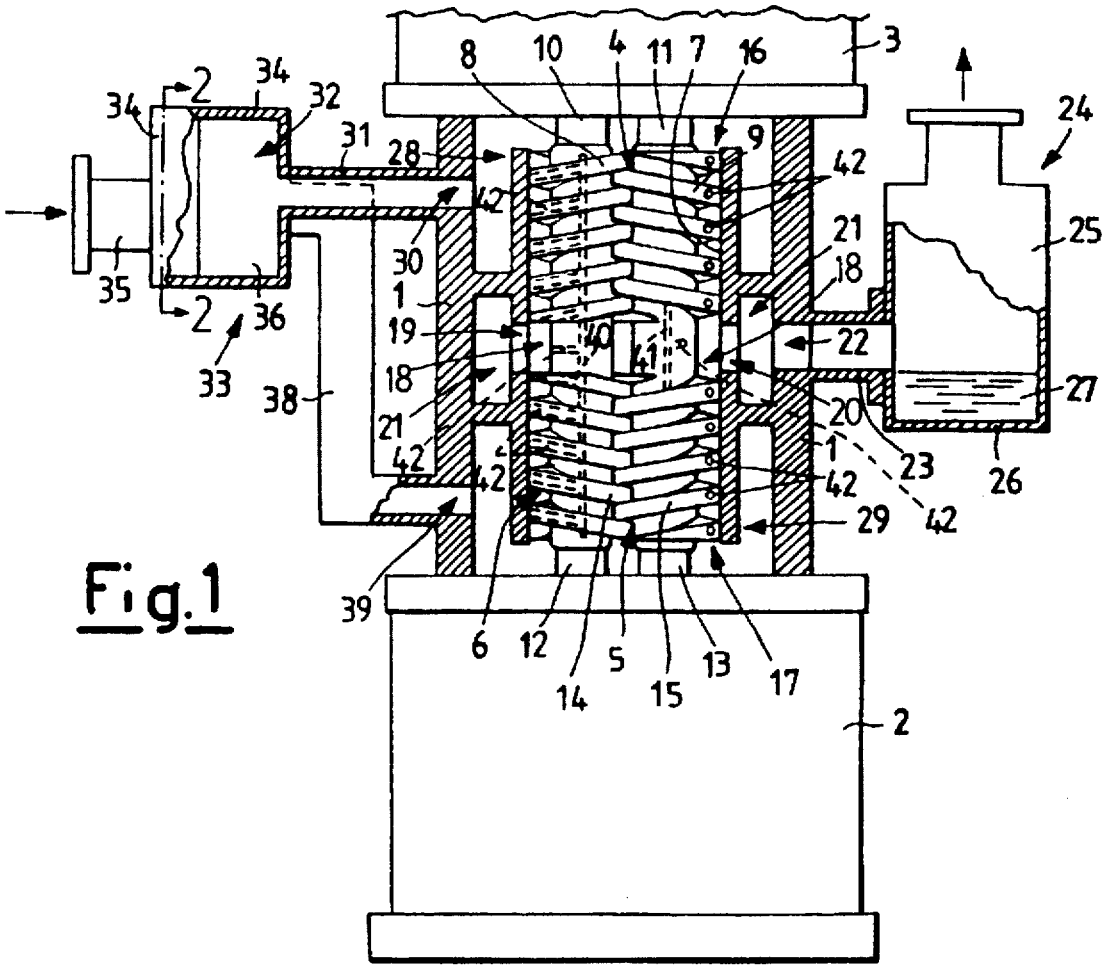
FIG. 1 shows a partial sectional frontal view of a twin-screw pump according to the invention.
Figure 2:
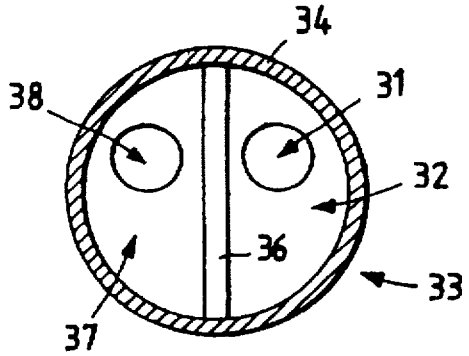
FIG. 2 is a lateral section view of the stream divider in agreement with the invention, according to line 2—2 of FIG. 1.

With reference to the Figures, 1 indicates the vertical pump body, basically cylindrically-shaped, which is closed at the bottom by the lubricating oil tank 2 and at the top by the electric motor 3, with a possible reducer. The motor 3 makes the twin pair of conical screws, 4 and 5 respectively, vertically arranged, rotate inside a pumping chamber 6 which is also vertical and bordered by the cylindrical wall 7 co-axially arranged inside the pump body 1. The conical screws 8 and 9 of the upper pair of screws 4 are interlocked and their shafts 10 and 11 are co-axially connected in series with the corresponding shafts 12 and 13 of the other lower pair of screws 5, whose conical screws 14 and 15 are also interlocked. The propeller of the upper pair of screws 4 is opposite to that of the lower pair of screws 5 in order, as can be clearly seen in FIG. 1, to convey both the streams, from the upper end of the pumping chamber or upper feeding mouth 16 and from the lower end or lower feeding mouth 17 respectively, towards the centre 18 of the pumping chamber 6. This centre 18 communicates, by means of inlets 19 and 20 situated in the cylindrical wall 7, with a delivery chamber 21 whose delivery mouth 22, situated in the pump body 1, is connected, by means of pipe 23, to a liquid seal generator of the liquid phase 24. This generator 24 is basically an upward defletor tube of the stream 25, which maintains a liquid seal 27 on the bottom 26. The delivery chamber 21 then describes, between the pump body 1 and external wall of the pumping chamber 6, an upper chamber 28 communicating with the upper feeding mouth 16 and a lower chamber 29 communicating with the lower feeding mouth 17. The chamber 28, communicates with the chamber 32 of a horizontal stream divider 33. The horizontal stream divider 33 comprises a horizontal expansion/separation barrel 34 which is connected to the suction pipe 35. The end of the horizontal expansion/separation barrel 34 which is connected to the suction pipe 35 includes a vertical internal dividing wall 36 which extends about half-way down the barrel 34 and creates two equal chambers 32,37. One of the barrel chambers 32 is connected to the upper pumping chamber 28 by means of a pipe 31 and inlet 30 situated on the pump body 1. The other barrel chamber 37 is connected to the lower pumping chamber 29 by means of a another pipe 38 and another inlet 39 situated on the pump body 1. By this arrangement, if a biphase mixture of liquid and gas is supplied by the suction pipe 35, the gas of the biphase mixture will settle in the upper part of the barrel 34 and the liquid will settle in the lower part of the barrel due to the effects of gravity. Then, as the biphase mixture passes through the vertical internal dividing wall 36 of the barrel 34, the biphase mixture will be perfectly subdivided into two equal streams which contain the same liquid and gas content. This ensures that whenever the pump is pumping a biphase fluid, the upper pumping chamber 28 and the lower pumping chamber 29 will always receive stream of fluid with the same liquid and gas content, even though the screw pump is operating in a vertical position.

The two vertical screw shafts 10,12 and 11,13 each include two radial channels 42 connecting from the delivery chamber 21 to a central axial channel in each shaft, 40 and 41, respectively. The axial channels 40 and 41 in each shaft also connect to a plurality of additional radial channels 42 which extend to the ends of the threads of the screws 4. This arrangement allows fluid from the liquid stored in the liquid seal generator 24 to be delivered through the axial and radial channels 40, 41 and 42 to the ends of the threads of said screws 4, thus creating an effective liquid seal which allows the pump to operate even in the transient phase where the fluid being pumped contains solely gas.

The invention in its broader aspects is not limited to the specific described embodiments and departures may be made therefrom within the scope of the accompanying claims without departing from the principles of the invention and without sacrificing its chief advantages.

We claim:

1. A twin-screw pump comprising:

a suction pipe for receiving a main stream of fluid;

a horizontal stream divider connected to said suction pipe which divides the main stream of fluid received by said suction pipe into a first stream and a second stream after the stream of fluid enters said suction pipe;

a housing enclosing a pumping chamber, wherein said pumping chamber includes a first pair and a second pair of screws vertically and rotatably mounted therein, each said screw of each said pair of screws including threads which interlock the two screws of each said pair of screws, each said screw including a shaft which extends axially through each screw, wherein the shafts of the first pair of screws are co-axially connected in series with the shafts of the second pair of screws at the center of said pumping chamber thus forming two vertical shafts which connect the first and second pairs of screws, and further wherein the screws may be rotated in synchronism such that each said pair of screws propels toward the center of said pumping chamber any fluid delivered to first or second pairs of screws;

a motor which rotates said screws in synchronism;

a first feeding mouth connecting said horizontal stream divider to said pumping chamber such that said first stream of fluid is fed to said first pair of screws;

a second feeding mouth connecting said horizontal stream divider to said pumping chamber such that said second stream of fluid is fed to said second pair of screws;

a delivery chamber located at the center of said pumping chamber which receives the fluid propelled by said screws, said delivery chamber including a mouth from which the fluid exits the pumping chamber; and a liquid seal generator connected to the mouth of said delivery chamber;

wherein each said vertical shaft of said screws include a radial channel connecting from the delivery chamber to a central axial channel in each shaft which connects to a plurality of radial channels which extend to the ends of the threads of said screws, such that fluid from the liquid seal generator may be delivered through the axial and radial channels to the ends of the threads of said screws.

2. A twin-screw pump according to claim 1, wherein said horizontal stream divider comprises a horizontal expansion/separation barrel including a first end and a second end, wherein the first end is connected to said suction pipe and includes a vertical internal dividing wall which extends about half-way down said barrel and creates two equal chambers which are each connected respectively to said first and second feeding mouths at the second end of said barrel.

* * * * *